US007494088B2

(12) United States Patent
Wadle'

(10) Patent No.: US 7,494,088 B2
(45) Date of Patent: Feb. 24, 2009

(54) QUICK RELEASE COIL MAKING MACHINE

(75) Inventor: Arnold D. Wadle', 1310 Dublin Blvd., Colorado Springs, CO (US) 80918-3211

(73) Assignee: Arnold D. Wadle', Colorado Springs, CO (US)

( * ) Notice: Subject to any disclaimer, the term of this patent is extended or adjusted under 35 U.S.C. 154(b) by 302 days.

(21) Appl. No.: 11/415,656

(22) Filed: May 2, 2006

(65) Prior Publication Data

US 2007/0257148 A1 Nov. 8, 2007

(51) Int. Cl.
*B65H 75/24* (2006.01)

(52) U.S. Cl. ..... 242/573.9; 279/2.12

(58) Field of Classification Search ..... 242/573.9, 242/573, 572, 571, 570, 472.5, 573.2, 573.7; 279/2.1, 2.11, 2.12, 2.22, 2.24
See application file for complete search history.

(56) References Cited

U.S. PATENT DOCUMENTS

| | | | | |
|---|---|---|---|---|
| 381,771 | A * | 4/1888 | Garsed | 242/573.2 |
| 1,670,886 | A * | 5/1928 | Fellows | 242/573 |
| 2,194,936 | A * | 3/1940 | Hatch | 73/480 |
| 3,097,841 | A * | 7/1963 | Boyd | 267/287 |
| 5,465,922 | A * | 11/1995 | Vander Groef | 242/573 |
| 5,772,151 | A * | 6/1998 | Teng | 242/573 |
| 6,830,211 | B2 * | 12/2004 | Sloan | 242/573.1 |
| 2006/0284384 | A1 * | 12/2006 | Schmitt | 279/2.22 |

FOREIGN PATENT DOCUMENTS

EP 96494 A2 * 12/1983

* cited by examiner

*Primary Examiner*—Peter M Cuomo
*Assistant Examiner*—Juan J Campos

(57) ABSTRACT

There is a central shaft. The central shaft is attached to a hole in the center of a round plate. Attached to the round plate is a multitude of arms that are able to pivot toward and away from the central shaft. There is a cone with a hole through it that fits onto the central shaft. The cone interfaces with the pivoting arms at the end away from the pivoting action.

3 Claims, 8 Drawing Sheets

60
31
15
23
21
55
53
21
52
43
22
10
33
41
32

QUICK RELEASE COIL MAKING MACHINE

BACKGROUND OF THE INVENTION

This invention relates to a non-binding quick release coiling & reeling machine, specifically to the wire, rope and cable industry.

Heretofore, mechanical coiling devices are used in numerous types of business and industry that require the operation of looping or coiling of longitudinal material from a large supply spool of material to a smaller loop or coil that can be easily dispensed or used. The preferred method is to use equipment that wraps the material around a multitude of rotating coiling arms. The arms are mounted to and positioned around a central shaft that can be rotated. A lever is included that allows coiling arms to be moved slightly towards or away from the central shaft. For the coiling operation; the lever is moved to a position that moves the coiling arms away from the central shaft, into a locking position that insures that the coiling arms will not retract towards the central shaft during the coiling operation. Locking mechanism includes metal to metal friction or passing the coiling arms through a detent position. The longitudinal material can now be coiled onto the coiling arms by rotating the central shaft. The coiling of the material around the coiling arms results in pulling the material tight around the coiling arms. This pressure increases based on several factors.

(a) Mass of the material.

(b) Friction from the supply spool.

(c) Length/number of loops of the new coil being made.

The coiling arms operate in an expanded position and must release the coil in some manner in order for the coiled material to be removed. The standard method of release is to move the control lever to collapse the coiling arms inward toward the central shaft thereby moving the coiling arms away from the new coil. The models that use a locking mechanism relying on friction are inherently the worst as friction mechanisms easily bind and wear out thereby over time becoming increasingly difficult to engage and release.

Other coiling mechanisms employ a detent locking position that relaxes the coiling arms towards the central axis thereby relying on inward force of the material being coiled to lock the coiling arms in position for coiling. The major problem with the detent mechanism is the new coil must be slightly stretched when moving the control lever to release the coil. This may damage the coiled material as well as cause wear on the locking mechanism. These coiling devices can be found in many of the home improvement stores around the United States typically in the electrical wire department. The operation of these devices is so bad that store personnel will often mark a scale on the floor and stretch wire across the scale to determine the length to sell and then coil the wire by hand. Very inefficient and a tripping hazard in some cases. Another disadvantage of existing coiling machines is that coil stop arms are raised in front of the coiling arms. These stop arms are a hazard during the coiling operation as they could easily bump an operator during the coiling operation or entangle the material being coiled.

SUMMARY OF THE INVENTION

Accordingly, several objects and advantages of my invention of a non-binding, quick release mechanism submitted here for patent protection are:

(a) To provide a coiling machine in which engagement of the coiling arms into the position for coiling relies on a movable control member that has a conically shaped profile that blends into a cylindrical profile. The conically shaped profile acts as an inclined plane when the control member is moved toward the coiling arms. The coiling arms are allowed to pivot outward to form parallel coiling arms equally positioned around a rotational axis. The cylindrically shaped engagement portion of the moveable control member then holds the position of the coiling arms during the coiling operation, no locking mechanism is required. This holding mechanism relies on the flat surface interface between the cylindrical profile and a corresponding flat surface feature on pivoting coiling. There are no friction or detent features that wear with use.

(b) Disengagement of the coiling arms is accomplished with the same moveable member. When the moveable control member is moved away from the coiling arms the flat surfaces disengage and the coiling arms pivot towards the rotational axis with coiling arms forming a rhomboid shape with respect to the rotational axis. The completed coil of longitudinal material can now be easily removed by moving the coiled material toward the narrower section of the rhomboid. Again, there are no friction or detent features that wear with use.

(c) The length of the coiling arms eliminates the need for coil stop arms.

DETAILED DESCRIPTION OF THE INVENTION

Figure 1:
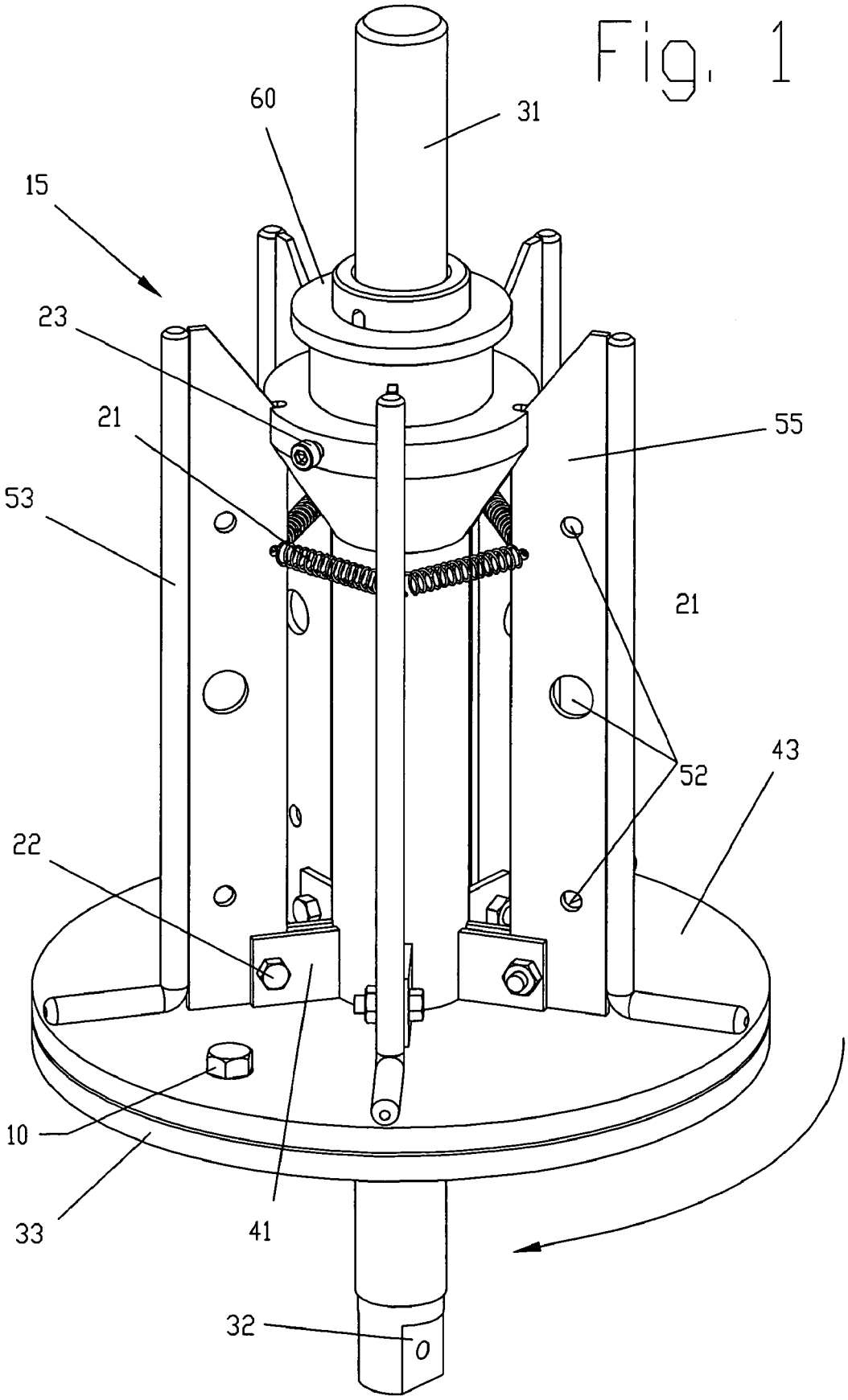
FIG. 1 shows the complete coil making device mounted on the rotational drive assembly with an arrow that shows the direction of rotation.
Figure 2:
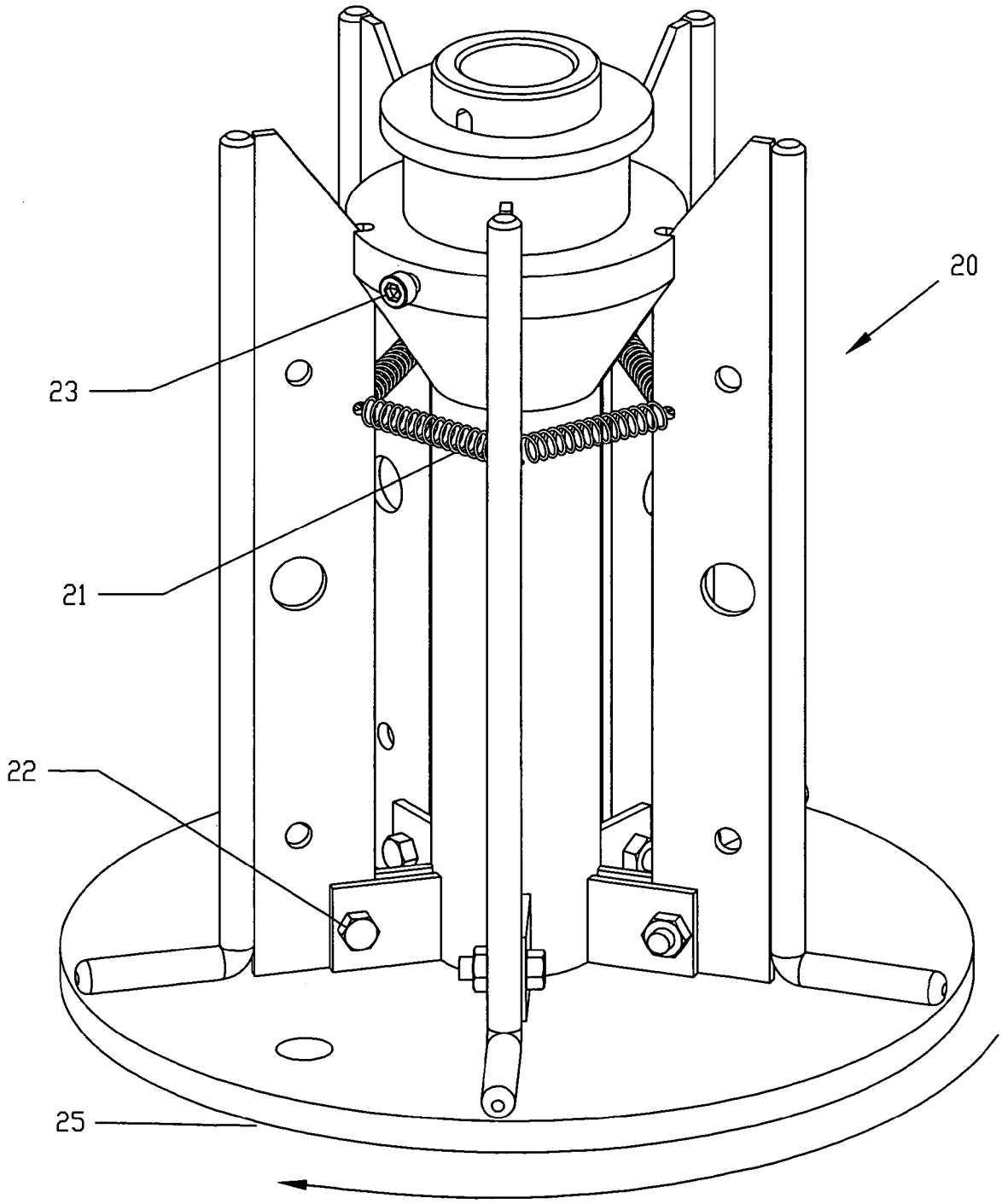
FIG. 2 shows the complete coil making device by itself, detached from the drive assembly.
Figure 3:
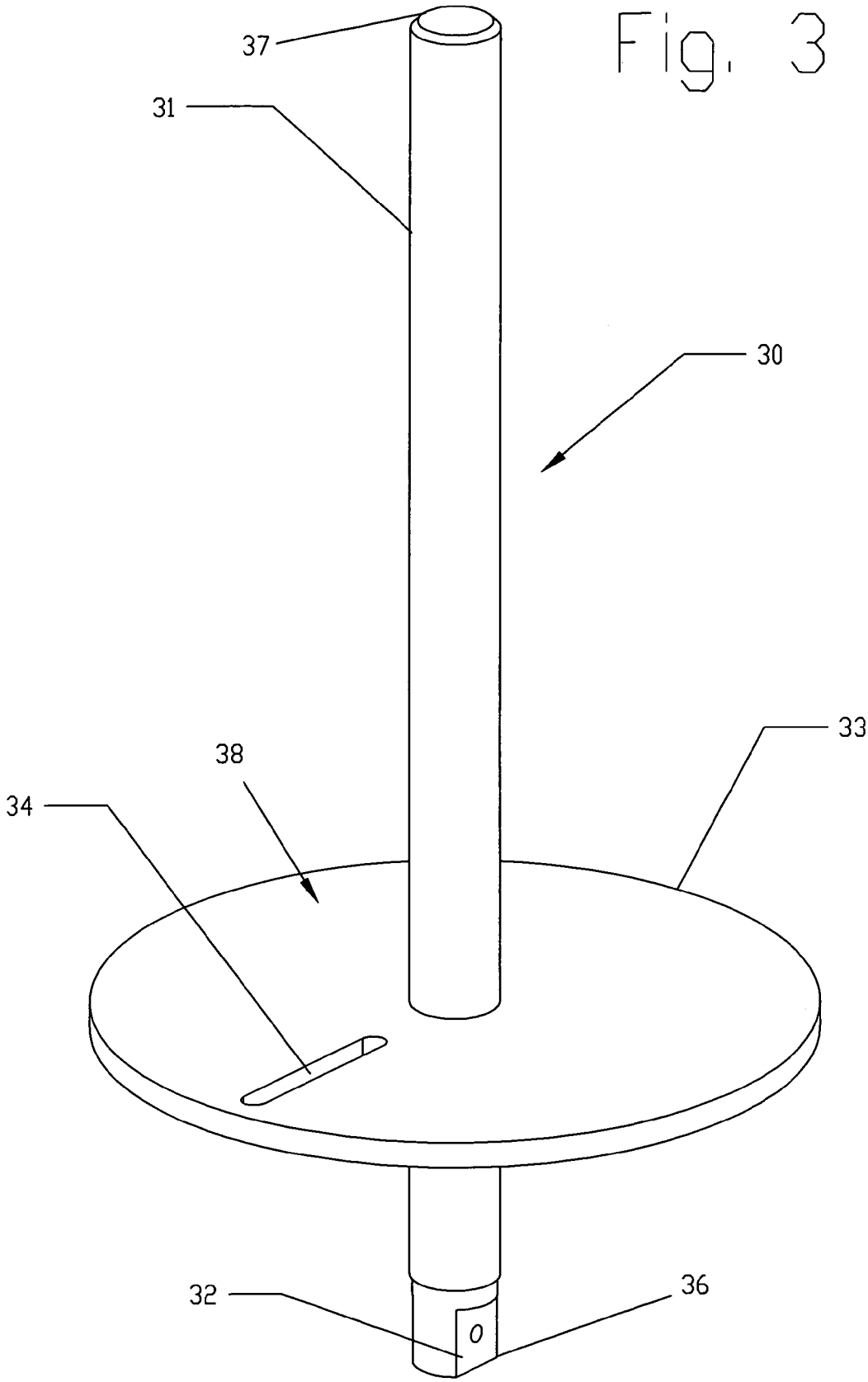
FIG. 3 depicts the rotational drive assembly.
Figure 4:
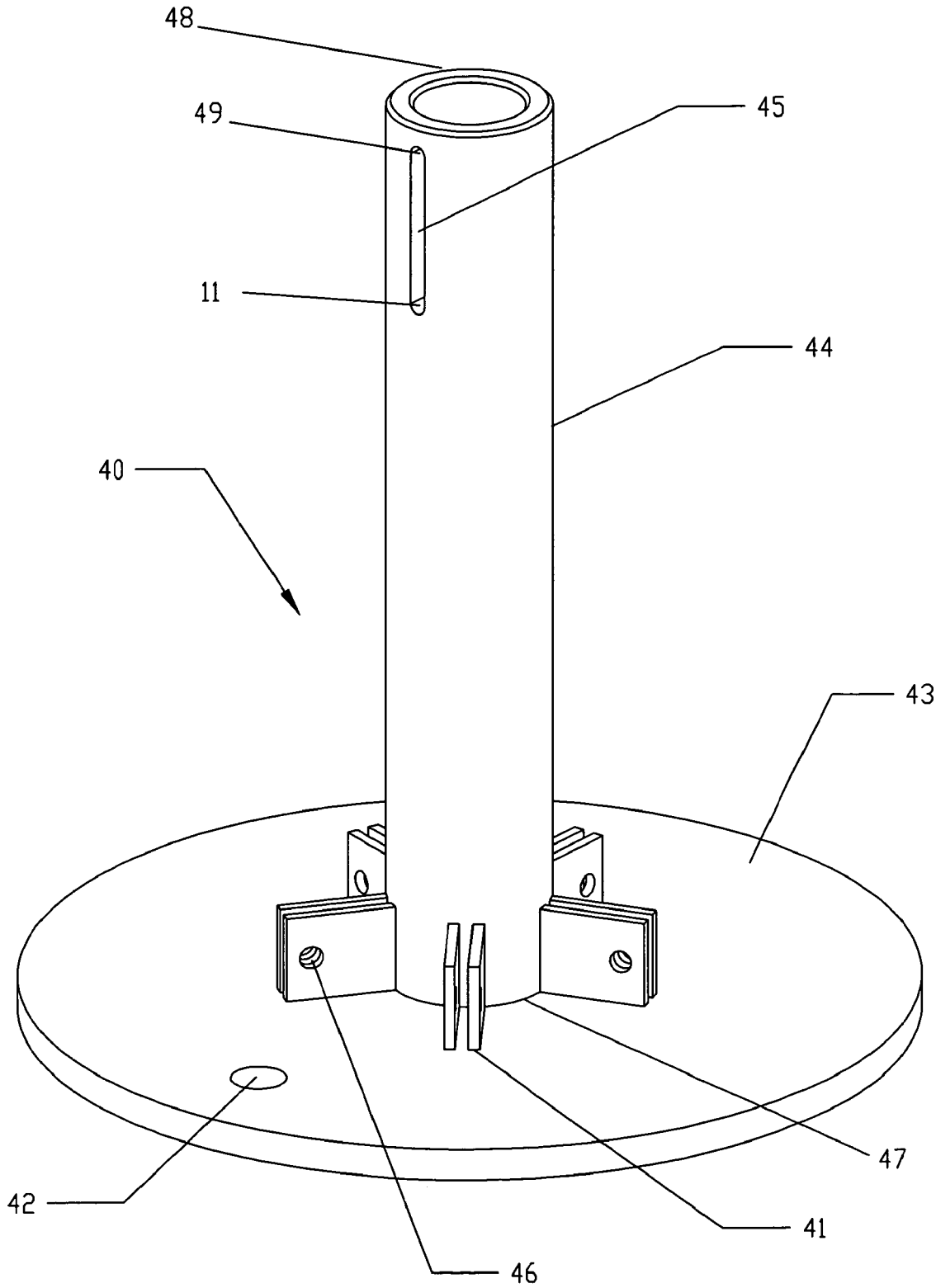
FIG. 4 depicts the coil maker body assembly.
Figure 5:
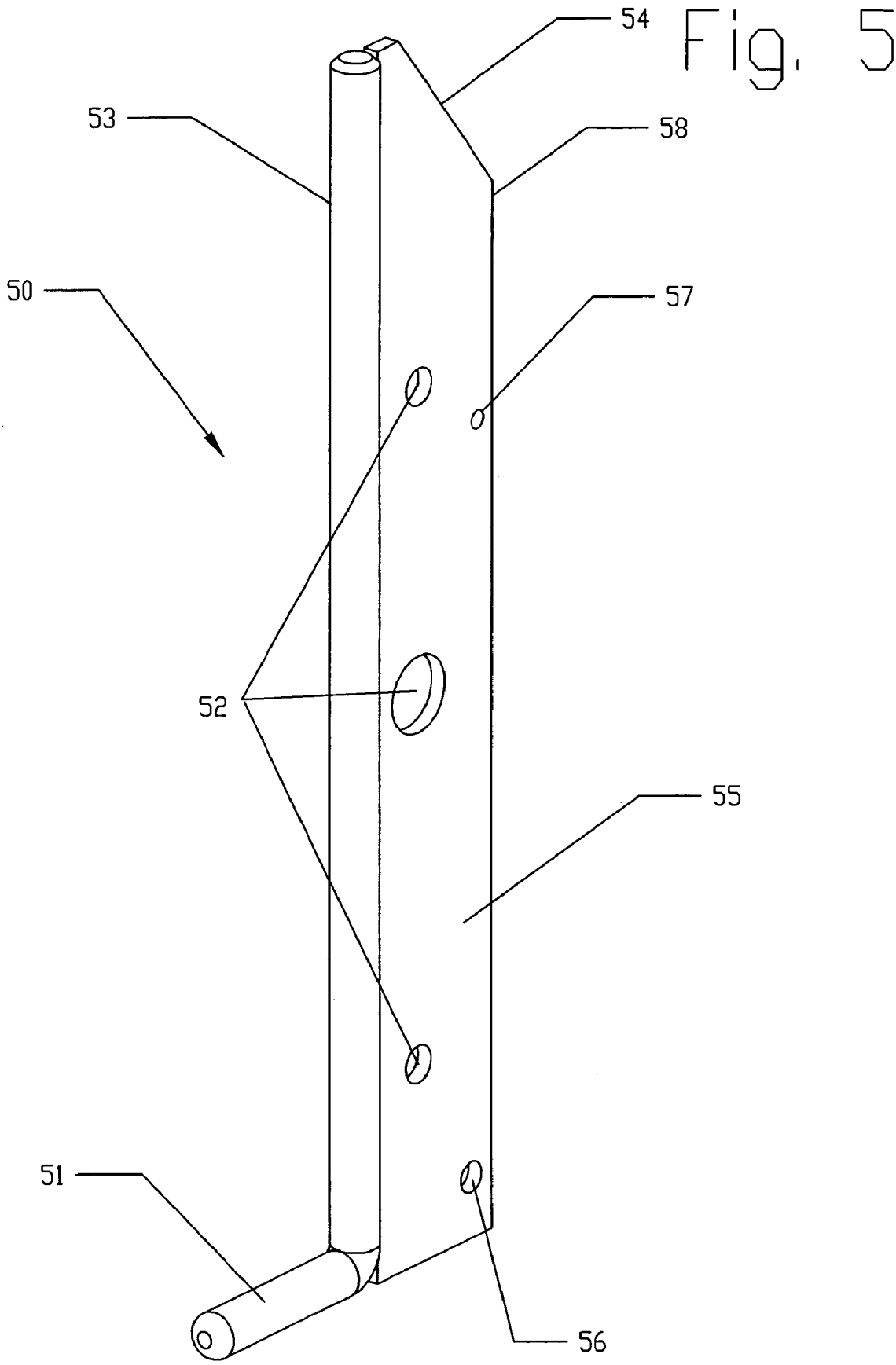
FIG. 5 depicts one of the coil support arms.

The present invention relates to a non-binding quick release coiling & reeling device. FIG. 1 is view of the complete coiling invention. FIGS. 1 through 8 provide detail of all of the features of this invention. The coil making body assembly 40 is composed of a hollow coil maker support tube 44, a coil maker back plate 43 and coiling arm retainer fins 41. The coil maker support tube 44 has two ends a proximal end 47 and a distal end 48. The proximal end 47 is attached to the center of the coil maker back plate 43, in this case via a weld joint. The distal end 48 of the coil maker tube 44 has a motion limit slot 45 cut through the wall of the coil maker support tube 44.

The coil maker support tube 44 should turn true perpendicular to the coil maker back plate 43. Coil arm retainer fins 41 are attached in pairs equally spaced around the hollow coil maker support tube 44. In this illustration there are five coil arm retainer fins 41; however more or less may be used. There is a coil arm attachment hole 46 in each of the coil arm retainer fins 41 used to attach the coil arms 50 to the coil making body assembly 40. The coil arms 50 have a corresponding pivot hole 56. The coil arms 50 are attached between the pairs coil arm retainer fins 41 using a pivot arm attachment pin 22. The coil arm attachment pin 22 can be a nut and a bolt sized to allow the coil arm 50 to freely pivot towards and away from the coil maker support tube 44 there by allowing the coil support rod 53 to become parallel to the coil maker support tube 44 or form a rhomboid shape with respect to the coil maker tube 44.

The coiling arm 50 can be fabricated in a variety of methods according to preference and material to be coiled. The chosen method for this illustration in FIG. 5 consists of welding a circular coil support rod 53 to a flat arm 55. The coil support rod 53 is formed at a right angle to form a support rod extension 51 to provide containment of the coiled material. The flat arm 55 has a shape changing chamfer 54 at one end. The importance of the shape changing chamfer 54 will be seen later in this patent. Alternately the pivot arm could be fabricated from a single piece of material with characteristics consistent with the weight and the size of the material to be coiled.

Figure 6:
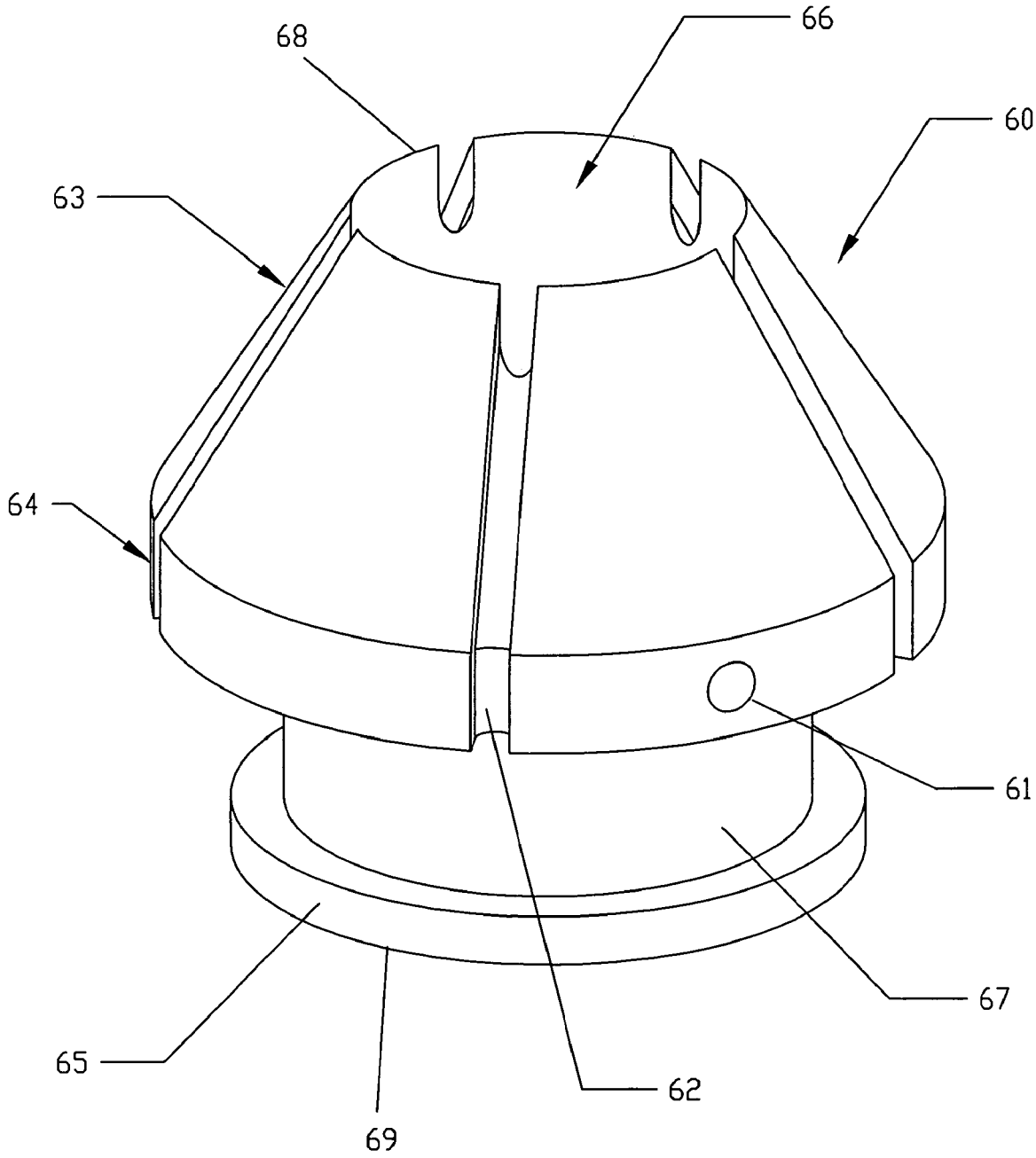
FIG. 6 depicts the shape changing engagement cone.
Figure 7:
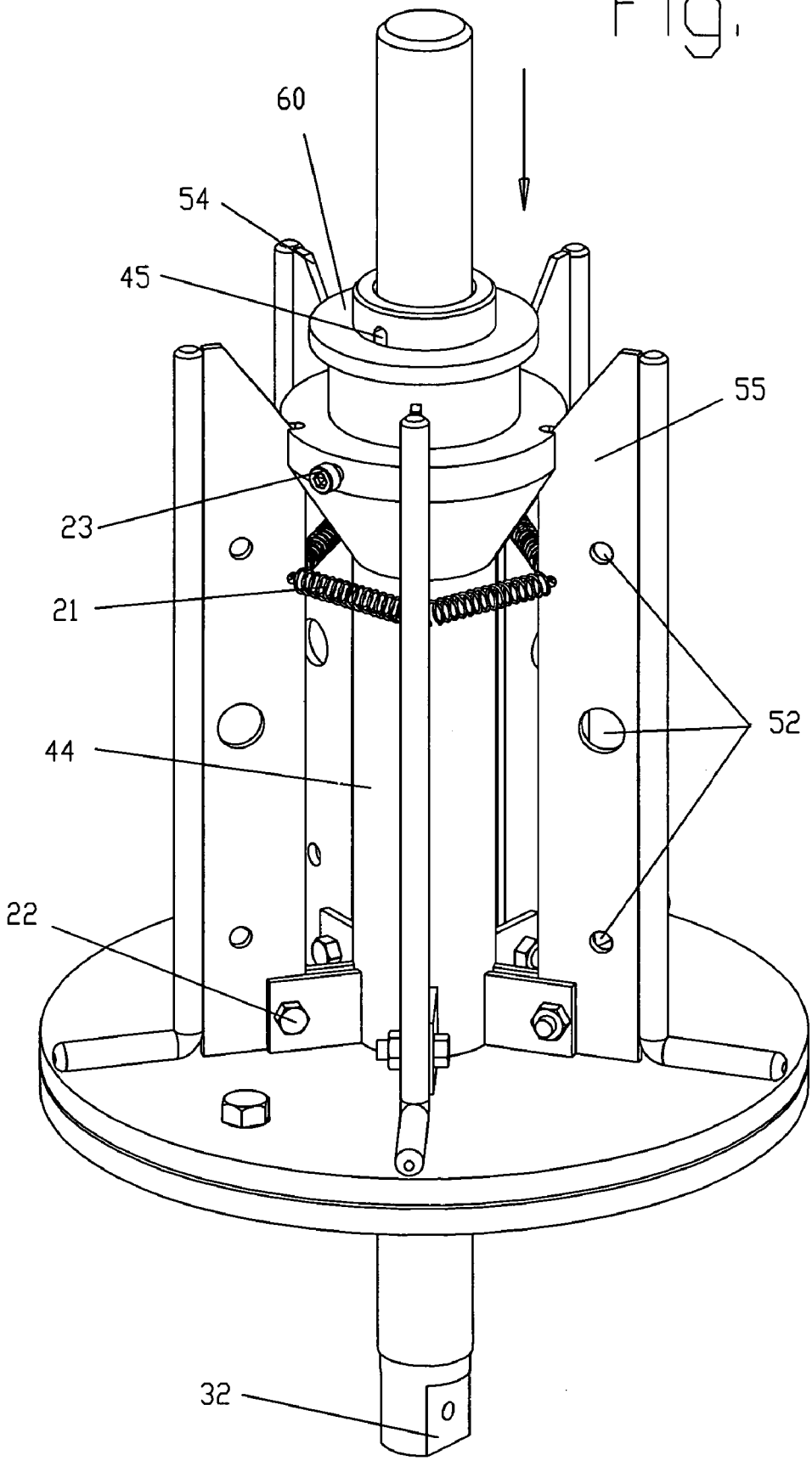
FIG. 7 depicts the coil maker with the shape changing engagement cone fully engaged in the direction shown by the arrow. This causes the coil support arms positioned around the rotational axis to become parallel to the rotational axis in a position suitable for turning longitudinal material into a coil.
Figure 8:
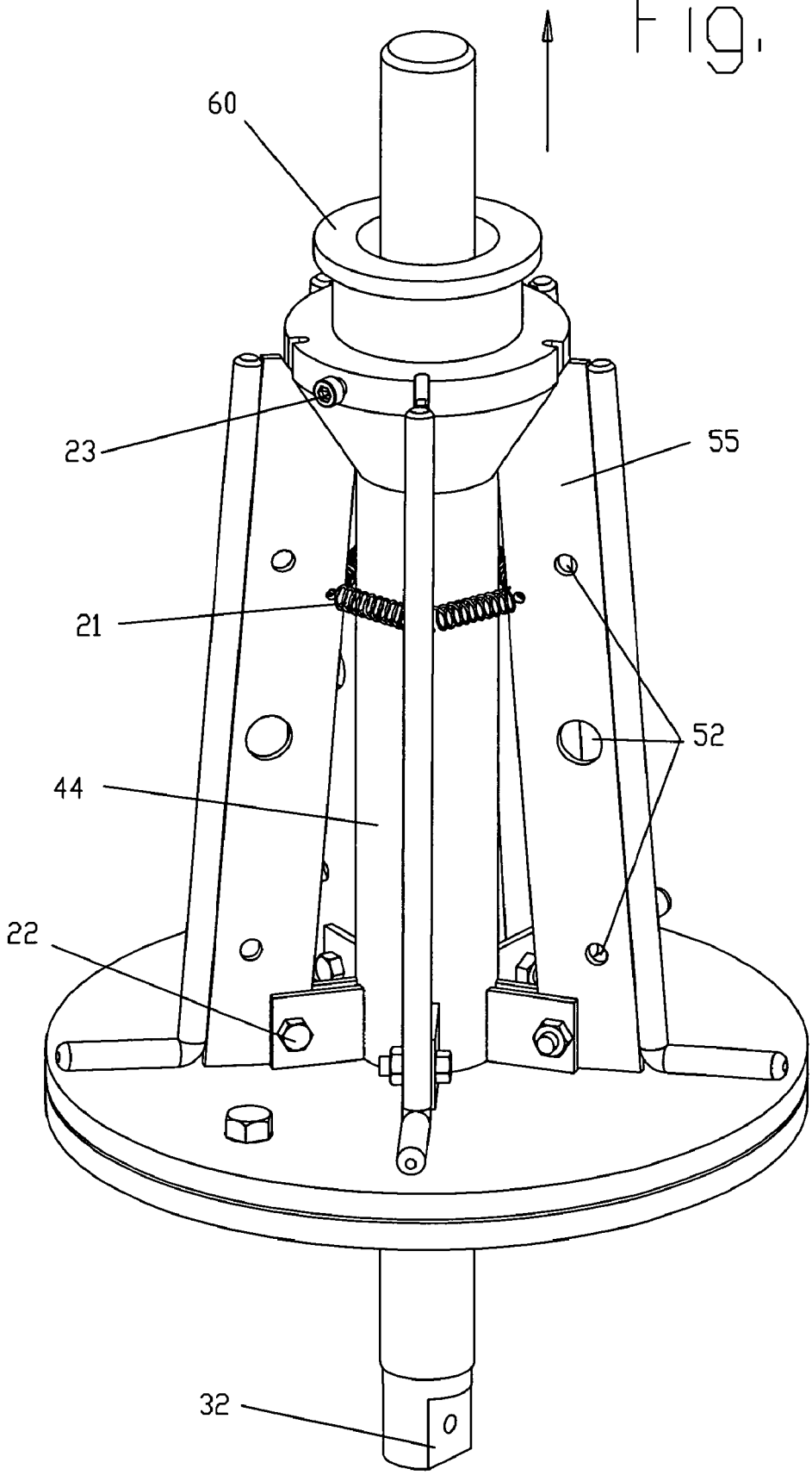
FIG. 8 depicts the coil maker with the shape changing engagement cone fully disengaged in the direction shown by the arrow. This causes the coil support arms around the rotational axis to form a rhomboid shape suitable for easy removal of a coil from the coil maker.

The shape changing cone 60 for this illustration is machined of aluminum as shown in figure 6. The shape changing cone has two ends, a proximal end 68 and a distal end 69. The proximal end 68 of the shape changing cone 60 has a cylindrical shaped engagement portion 64 and a conically shaped portion 63. Grooves having the same profile as the cylindrical shaped engagement portion 64 and the conically shaped portion 63 are formed equally spaced around the circumference of both in a quantity equal to the number of coiling arms 50 used and having a depth and a width slightly wider than the flat arm 55 portion of the coiling arm 50. The distal end 69 of the shape changing cone 60 has a spacing groove portion 67 that separates the engagement flange portion 65 from the proximal portions of the shape changing cone 60. The shape changing cone 60 has a bore 66 through it with a diameter slightly larger than the coil maker support tube 44. There is a threaded stop screw hole 61 extending from the outside surface of the cylindrical shaped engagement portion 64 through to the bore 66.

The proximal end 68 of the bore 66 of the shape changing cone 60 is now aligned with the distal end 48 of the coil maker support tube 44. The support beam retaining grooves 62 should be aligned with the coil arm 50 engagement chamfer 54. The coil maker support tube can now be passed through the bore 66 until the stop screw hole 61 is in alignment with the motion limit slot 45 on the coil maker support tube 44. The stop screw 23 is now installed to the point that it fully protrudes into the motion limit slot 45. Pivot arm retraction springs 21 are now installed between each adjacent pivot arm 55 being connected at the retraction spring attachment holes 57. The pivot arm retraction springs 21 hold the flat arms 55 securely in the support beam retaining grooves 62.

Another embodiment of this invention is a separate drive assembly 30. The drive assembly is composed of a solid main drive shaft 31 with a diameter that is slightly smaller than the inside diameter of the coil maker support tube 44. The main drive shaft has two ends, a proximal end 36 for connection to a rotational driving force and a distal end 37 for mounting the coil maker body assembly 40 or a spool. The proximal end 36 of the main drive shaft 31 has drive connection 32 that in this case is composed of a flat ground into the main drive shaft 31. Located near the proximal end 36 of the main drive shaft is a drive attachment plate 33 that has been welded to the main drive shaft 31. Located in the drive attachment plate 33 is a spool/coil maker attachment slot 34. The length of the main drive shaft 30 extending from the distal face 38 of drive attachment plate is slightly longer than the full length of the coil maker support tube 44.

Operation-FIG. 1 Through 8

In operation that proximal end 36 of the coil drive assembly 30 is securely fastened to an electro/mechanical drive unit capable of supporting the weight of the drive assembly 30, the complete coil molding assembly 20 and any material that is to be coiled. The electro/mechanical drive unit provides a rotational force. The proximal end 47 of the coil maker support tube 44 is now aligned with the distal end 37 of the main drive shaft 31. The complete coil making assembly 20 can now be positioned so the proximal face 25 of the coil maker back plate 43 mates with the distal face 38 of the drive attachment plate. The drive attachment hole 42 should be aligned with the spool/coil maker attachment slot 34 and a drive fastener 10 installed to secure the complete coil making assembly 20 to the drive assembly 30.

The drive unit can be operated by a foot control switch and the speed of the rotation controlled by a variable speed control. The first step of the process is the operator grasps the engagement flange 65 and positions the shape changing member 60 in the direction indicated by the arrow in figure 7.

This motion causes the conically shaped portion 63 of the support beam retaining groove 62 to engage the shape changing chamfer 54 on the flat arm and causes the coil arms 50 to pivot away from the coil maker support tube 44. The stop screw 23 encounters the distal end 11 of the motion limit slot 45 which limits the motion of the shape changing member 60. At this point the engagement surface 58 of the pivot arm 50 is in contact with the cylindrical engagement portion 64 of the support beam retaining groove 62. This holds the pivot arms 50 parallel to the coil maker support tube 44 without creating a binding force and not relying any locking mechanism to maintain engagement.

The operator then takes the lead-end of the material to be coiled, typically supplied from a larger spool of material, and makes one wrap around all of the coiling arms 50 and inserts the lead-end of the material into one of multiple coil material engagement holes 52 in one of the flat arms 55. The operator actuates the foot control switch applying power to the drive unit. The coilmaker rotates and draws the material onto the coiling arms. When the desired length (determined by auxiliary device) is drawn onto the coiling arms 50 the operator takes his/her foot off of the foot switch which causes the coil maker to stop rotating. The operator cuts the material to separate it from the source. At this point the operator can attach one or more wire ties to the coil in the spaces between the coiling arms 50 to prevent unraveling of the newly formed coil. The operator grasps the engagement flange portion 65 and positions the shape changing member 60 in the direction indicated by the arrow in figure 8. This motion causes the conically shaped portion 63 of the support beam retaining grooves 62 to disengage the shape changing chamfer 54 on the flat arm and allows the shape changing chamfer 54 to slide into the conically shaped portion 63 of the support beam retaining grooves 62. This action allows the coiling arms 50 to pivot towards the coil maker support tube 44 forming a rhomboid shape with respect to the coil maker support tube. The stop screw 23 encounters the proximal end 49 of the motion limit slot 45 which limits the motion of the shape changing member 60. The coiling arms 53 are now moved away from the coiled material. The coil can now easily be removed from the coil making machine. There is no damage to the coiled material and no excessive wear on the coil making machine.

Accordingly, the reader can see that the non-binding, quick release operation of this invention can be used to coil/wrap various gauges of wire or rope easily and conveniently without damage to the material being coiled.

The fundamental aspect making this assembly unique is the relationship between the coiling arms and the shape changing cone. All other mechanisms doing the same function as this device rely on friction or a detent position for expansion. Friction type devices are prone to slippage which is counteracted by increasing the friction which causes difficulty to release and results in rapid wear. Detent type devices are self-trapped in the expanded position by compression from the material being coiled. Some amount of stretching or deforming of the coiled material is required to move the assembly back over center, out of the detent position. Depending on the compression force and material coiled, these type devices can be impossible to release. The device submitted here for patent protection does not require friction or detent to stay expanded. There is no slippage induced and thus virtually no wear. The mechanism does not have to move over center out of a detent position thus no stretching or deforming of material is required.

What is claimed is:

1. A longitudinal material coiling device comprising:

a coil supporting body assembly provided with a plurality of pivotable coiling arms;

said coiling arms provided with a plurality of return springs to maintain positioning of the coiling arms;

the coiling arms each having engagement holes that permit easy threading of feed material and easy removal of coiled material;

the coiling arms further provided with a chamfered portion for engaging a shape changing cone;

the shape changing cone having a conically shaped portion for pivotal connecting the coiling arms, a cylindrically shaped engagement portion for holding the coiling arms in position, and a plurality of grooves extending between both the conically shaped portion and the cylindrically shaped engagement portion that control extraneous and intrinsic forces which cause binding, and a flanged shaped portion for engaging the shape changing cone.

2. The longitudinal material coiling device according to claim 1, wherein the coiling arms extend longitudinally to support the material being coiled and have extension rod portions that prevent over-wrap of material into a drive mechanism.

3. The longitudinal material coiling device according to claim 1, wherein the coiling device is removable from a drive assembly.

* * * * *